US005392566A

United States Patent [19]

Wedeniwski

[11] Patent Number: 5,392,566

[45] Date of Patent: Feb. 28, 1995

[54] PROCESS AND DEVICE FOR NUMERICALLY CONTROLLED GRINDING OF CAMS OF A CAMSHAFT

[75] Inventor: Horst J. Wedeniwski, Remshalden, Germany

[73] Assignee: Fortuna-Werke Maschinenfabrik GmbH, Germany

[21] Appl. No.: 925,588

[22] Filed: Aug. 3, 1992

[30] Foreign Application Priority Data

Nov. 18, 1991 [DE] Germany ..... 4137924

[51] Int. Cl.[6] ..... B24B 1/00

[52] U.S. Cl. ..... 451/5; 451/11; 451/58; 451/62; 451/251

[58] Field of Search ..... 51/165 R, 165.71, 165.77, 51/105 R, 105 SP, 105 EC, 281 R, 281 C, 326, 327

[56] References Cited

U.S. PATENT DOCUMENTS 2,641,874 6/1953 Kirby ..... 51/281 C
4,197,679 4/1980 Yamada et al. ..... 51/105 EC
4,833,834 5/1989 Patterson et al. ..... 51/147

FOREIGN PATENT DOCUMENTS 52-151957 12/1977 Japan .
0785022 12/1980 U.S.S.R. ..... 1/281 C

*Primary Examiner*—Maurina T. Rachuba
*Attorney, Agent, or Firm*—Walter A. Hackler

[57] ABSTRACT

An apparatus and a method are disclosed for numerically controlled grinding of cams of a camshaft. The cams have a convex circular base section and a convex circular tip section with concave transitional sections interconnecting same. The concave transitional sections have a minimum radius of curvature. The cam is first ground with a first grinding wheel of a radius much bigger than the minimum radius of curvature, however, the cam material is not entirely removed during this first grinding step at the location of the concave sections, thus leaving there a zone of unground cam material. In a second grinding step, the cam is ground with a second grinding wheel of a radius being smaller than the minimum radius of curvature.

3 Claims, 4 Drawing Sheets

PROCESS AND DEVICE FOR NUMERICALLY CONTROLLED GRINDING OF CAMS OF A CAMSHAFT

The invention concerns a process for numerically controlled grinding of cams of a camshaft, in which, on the basis of a predefined cam contour, the camshaft is rotated about its long axis and simultaneously a grinding disk is advanced in a direction perpendicular to the long axis, with the cam contour having a concave curvature in the catch region and the runout region of the cam.

The invention further concerns a device for performing the aforesaid process, with a first grinding carriage that can move in a direction perpendicular to the long axis and carries a first grinding disk.

BACKGROUND OF THE INVENTION

A process and a device of the aforesaid kind are known.

The German book "The control of gas exchange in high-speed internal combustion engines," by W. D. Bensinger, Springer-Verlag, 1968, describes, among other things, cam shapes in which the flanks, i.e. the connecting segments between the base circle and the secondary circle, do not have the usual convex shape, but rather a concave shape, which is also referred to as a "hollow flank" (German book page 31, FIG. 40*c*).

Cam shapes of this kind are used in engine design to achieve good combustion chamber filling characteristics by means of rapid valve actuation. Although it is also possible to achieve similar results by applying multiple-valve technology, multiple-valve technology is essentially effective only at high engine speeds, while a cam shape with hollow flanks also improves filling characteristics at low speeds.

With known processes and devices, however, the cams ground were always ones in which the radius of curvature in the concave curvature region (the hollow flank) was at least as great as the radius of curvature of the single grinding disk used. It was therefore possible, for geometrical reasons, to grind cams of this kind—i.e. first to rough down and then to finish grind them—without re-chucking and with one and the same grinding disk.

With known cams of this type, therefore, when concave curvature regions with a relatively small radius of curvature were desired, a correspondingly small grinding disk therefore needed to be used.

However, the use of small-diameter grinding disks very soon encounters practical limits if the entire cam machining process, i.e. both roughing and finish grinding, is to be performed with the same small grinding disk. Specifically, there arise thermal problems at the grinding disk surface, which are naturally greater in smaller-diameter grinding disks than in those with a large diameter. Furthermore, it is difficult to mount small-diameter grinding disks in a spindle in such a way that the required rotation speeds and drive power levels can be applied, since the grinding disk usually rotates about an axis that lies parallel to the camshaft axis. This then creates the danger, however, that the mounting system for the grinding disk will collide with adjacent cams on the same camshaft that are as yet unmachined or have already been machined, if the diameter of the spindle is as great as that of the grinding disk. Although the grinding disk could also, in a known manner, be allowed to rotate about an axis that is inclined with respect to the long axis of the camshaft, by giving the grinding disk a conical surface, this would nonetheless lead to geometrical errors, since with numerically controlled cam grinding using simultaneous rotation of the camshaft and movement of the grinding disk perpendicular to the camshaft (X axis), the engagement line between the grinding disk and the cam wanders in a direction perpendicular to the X axis.

SUMMARY OF THE INVENTION

The underlying object of the invention is therefore to develop a process and a device of the aforesaid type in such a way that cams with a hollow flank, i.e. concave curvature, can be ground quickly, i.e. with a high level of drive power output and with a precise cam contour.

In accordance with the aforesaid process, this object is achieved by the fact that the cam is first ground with a grinding disk whose radius is very much greater than the minimum radius of curvature of the concave curvature, with the first grinding disk being guided along a first cam contour that is modified in the concave curvature region in such a way that its minimum radius of curvature is greater than or equal to the radius of the first grinding disk, so that in the concave curvature region, a zone located outside the unmodified first contour remains behind; and that then grinding is performed with a second grinding disk whose radius is less than the minimum radius of curvature of the concave curvature.

The object is also achieved by means of an aforesaid device with a first grinding carriage which can move in a direction perpendicular to the long axis and carries a first grinding disk, by the fact that arranged on the first grinding carriage is a second grinding carriage that can move relative to the first grinding carriage, again in a direction perpendicular to the long axis, and carries a second grinding disk, in such a way that by means of a movement of the second grinding carriage on the first grinding carriage, alternatively either the first or the second grinding disk can be brought into engagement with the cam.

The object on which the invention is based is completely achieved in this manner. Specifically, in accordance with the invention the machining of the cam is divided into two segments, with a grinding disk of conventional size removing a substantial portion of the machining allowance in a first machining step; the fact that the said zone, which is inaccessible to the large grinding disk because of its large radius, is left behind in the concave curvature region, is deliberately accepted. This zone is then removed in a second step using the small grinding disk, which also, in a subsequent step, provides final machining of the desired cam contour. This makes it possible to associate the large grinding disk, which is not subject to any physical space problems, with an ordinary high-power drive system; which the small grinding disk, which is subject to tight physical space conditions in the drive and mounting areas, need only be provided with a smaller drive of lower power, since the small grinding disk only needs to grind the residual zone and a small portion of the machining allowance, as usually occurs in a finish grinding procedure. These circumstances also have a positive effect on the lifetime of the grinding disks, since a large grinding disk is much more capable of removing large volumes of material than small grinding disks, in terms of the same service life in each case.

The process and the device according to the invention therefore make it possible, for the first-time, to grind cams with hollow flanks on an industrial scale with machining times that represent the current state of the art for cam grinding of camshafts of standard design (i.e. with convex flanks), i.e. approximately three to four seconds per cam, without thereby impairing the service life of the grinding disks.

In a preferred embodiment of the process in accordance with the invention, after grinding with the first grinding disk the cam is brought to a stop and the zone is essentially ground away with the second grinding disk by plunge grinding.

The advantage of this feature is that practically the entire zone can be ground away in one very rapid operation, with no need for a time-consuming along-path operation, since the cam is stationary during this machining phase and the second, small grinding disk plunges into the zone only in an advance operation. Since the cam contour in the concave curvature region usually has essentially the shape of an arc of a circle, the residual zone can be ground away almost completely by a single plunge of the second grinding disk.

In a development of the aforesaid exemplary embodiment, the cam is once again rotated after plunge grinding, and ground with the second grinding disk along a second contour located inside the first contour.

This feature has the advantage, already mentioned earlier, that the last machining procedure, i.e. usually finish grinding, can be performed by the second, small grinding disk, which is not problematic in terms of either machining time or service life, since only very small volumes of material are removed in this last grinding procedure.

In a preferred embodiment of the device in accordance with the invention, the radius of the second grinding disk is dimensioned according to the formula:

$$R_{s2} = f\left(\rho_{k\,min};\ \frac{d^2S_N}{d\phi^2};\ k\right) \approx K \cdot \rho_{k\,min}$$

where $\rho_{k\,min}$ is the minimum radius of curvature of the concave curvature; $d^2S_N/d\cdot\phi^2$ is the circumferential acceleration of the engagement line of the second grinding disk in the concave curvature region, and $\omega_k$ is the angular velocity of the camshaft about its long axis, with K being between 0.6 for large angular velocities ($\omega_k > 8{,}000$ degrees/min) and 0.9 for small angular velocities ($\omega_k < 4{,}000$ degrees/min).

The advantage of this feature is to produce the largest possible radius for the second grinding disk, which is capable, even with allowance for dynamic effects (i.e. possible drag defects), of grinding away the concave curvature region without geometrical errors.

Further advantages are evident from the description and the attached drawings.

It is understood that the aforesaid features and those yet to be explained below can be used not only in the particular combination indicated, but also in other combinations or in isolation, without leaving the context of the present invention.

BRIEF DESCRIPTION OF THE DRAWINGS

An exemplary embodiment of the invention is depicted in the drawings and will be explained in more detail in the description below. In the drawings.

DETAILED DESCRIPTION

Figure 1:
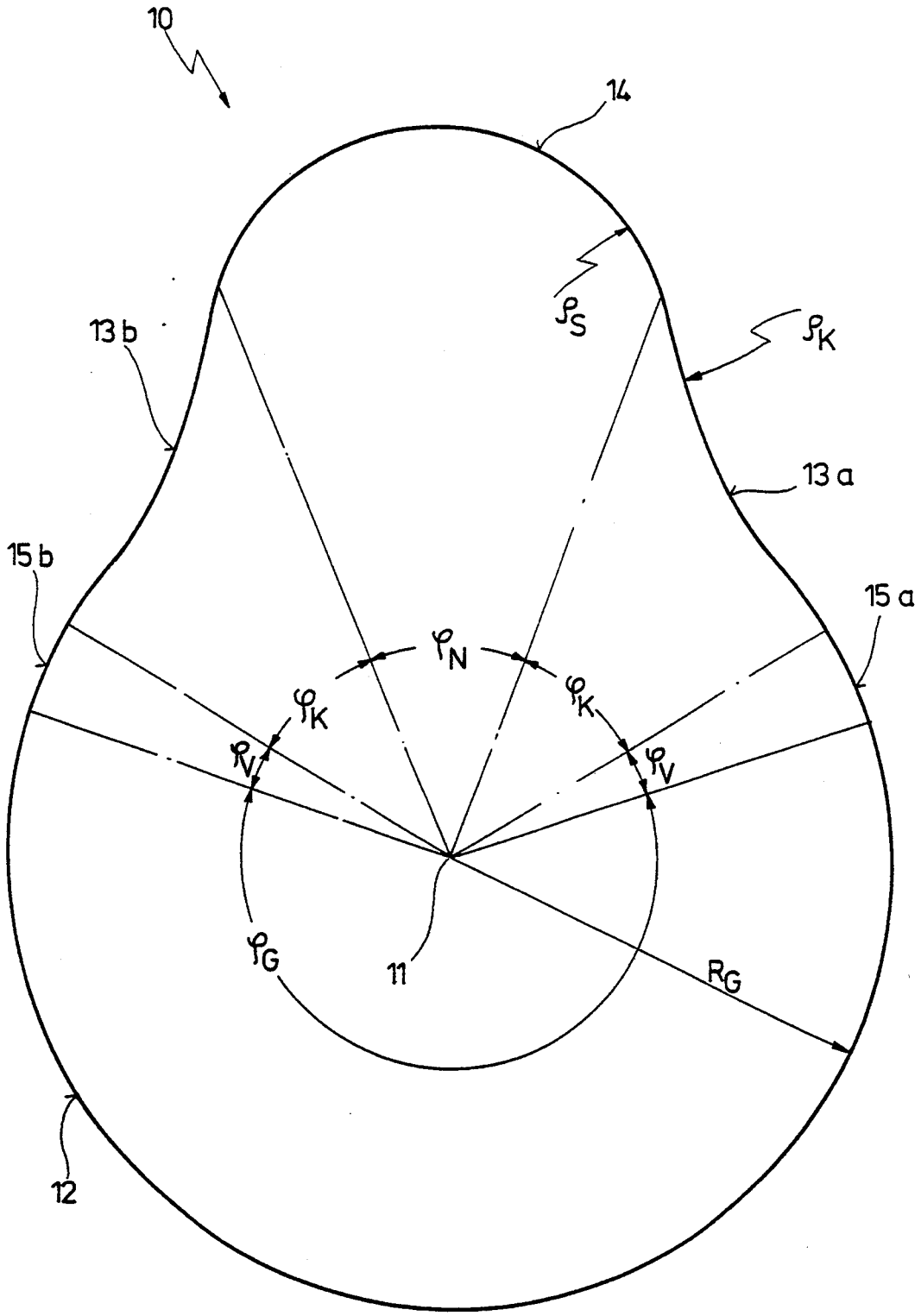
FIG. 1 shows a side view of an exemplary embodiment of a cam with hollow flanks (not to scale)

FIG. 1 depicts (not to scale) a cam 10 as used for camshafts of motor vehicle engines.

The cam 10 can rotate about a rotation axis 11, which is also the long axis of the camshaft (not depicted).

The cam 10 has, in a known manner, a base circle segment 12 with a radius $R_G$, the center of which coincides with the rotation axis 11. The base circle segment 12, which occupies a circumferential angle $\phi_G$ in the cam 10, continues via the pre-cam region **15*a*/15*b* on the catch side into a concave flank segment 13*a* and on the opposite runout side into a second concave flank segment 13*b* of the cam 10, each of which occupies a circumferential segment $\phi_k$. The pre-cam segments 15*a* and 15*b* of the cam 10 have a convex-curved region as transition between the base circle segment 12 and flank segment 13*a* and 13*b*, covering a circumferential angle $\phi_v$. In the tip region, the cam contour then has a convex segment 14 that has a variable radius $\rho_s$. The tip circle segment 14** occupies a circumferential angle $\phi_s$.

As is clearly evident from FIG. 1, the contour of the cam 10 is designed so that the catch segment **13*a* and the runout segment 13*b***, i.e. the cam flanks, are not convex in the usual way, but instead have a concave curve. This phenomenon is also referred to as "hollow flanks."

The reason for this feature is to achieve, during actuation of the tappets for the valves of the engine, a faster catch and runout onto and from the secondary circle segment 14, so as to improve the filling characteristics of the combustion chambers.

Also in FIG. 1, $\rho_k$ designates the radius of curvature of the segment **13*a*, 13*b*; it is evident that this radius of curvature $\rho_k$ is oriented opposite to the radii of curvature $R_G$ and $\rho_s$ of base circle segment 12 and tip circle segment 14. It is understood that the radius of curvature $\rho_k$ is not constant. The minimum radius of curvature $\rho_{k\,min}$ of the segments 13*a* and 13*b* is therefore an important variable for the machining of these segments 13*a* and 13*b***.

For example, it is certainly obvious that the segments **13*a* and 13*b*** can only be ground away with a grinding disk whose radius is less than the minimum radius of curvature $\rho_{k\,min}$, since otherwise geometrical errors would arise. In practice, the selected radius of the grinding disk is in fact significantly smaller in order to reduce the osculation, so that contact between the grinding disk and the workpiece in the concave region corresponds to a contact line.

In the other regions of the cam contour, however, namely in the base circle segment 12, in the pre-cam segment **15*a*/15*b*, and in the tip circle segment 14**, the radius of the grinding disk plays no role in terms of geometrical accuracy, since these regions are convex curved and therefore, at least theoretically, can be ground with grinding disks of any desired radius.

Figure 2:
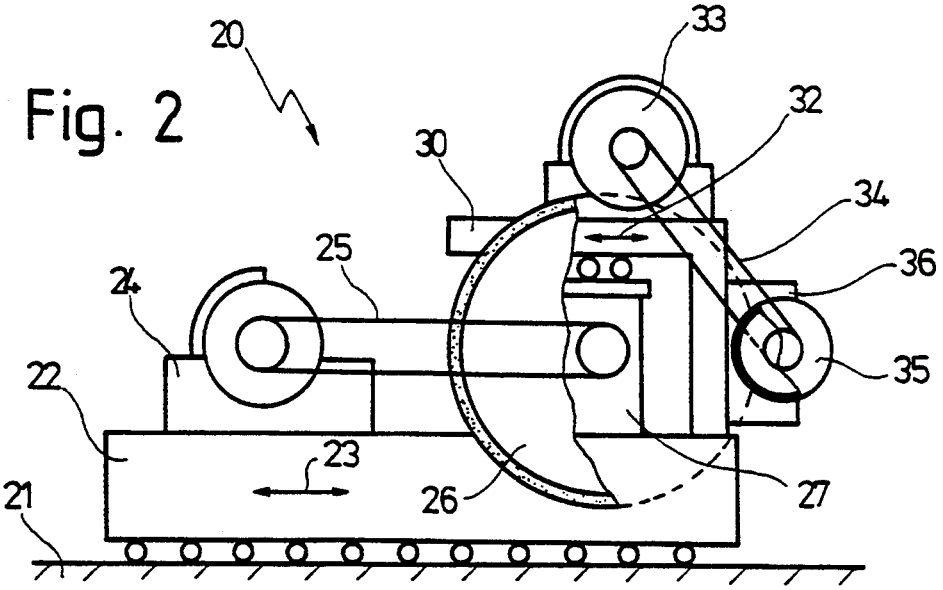
FIG. 2 shows a side view of an exemplary embodiment of a device in accordance with the invention.
Figure 3:
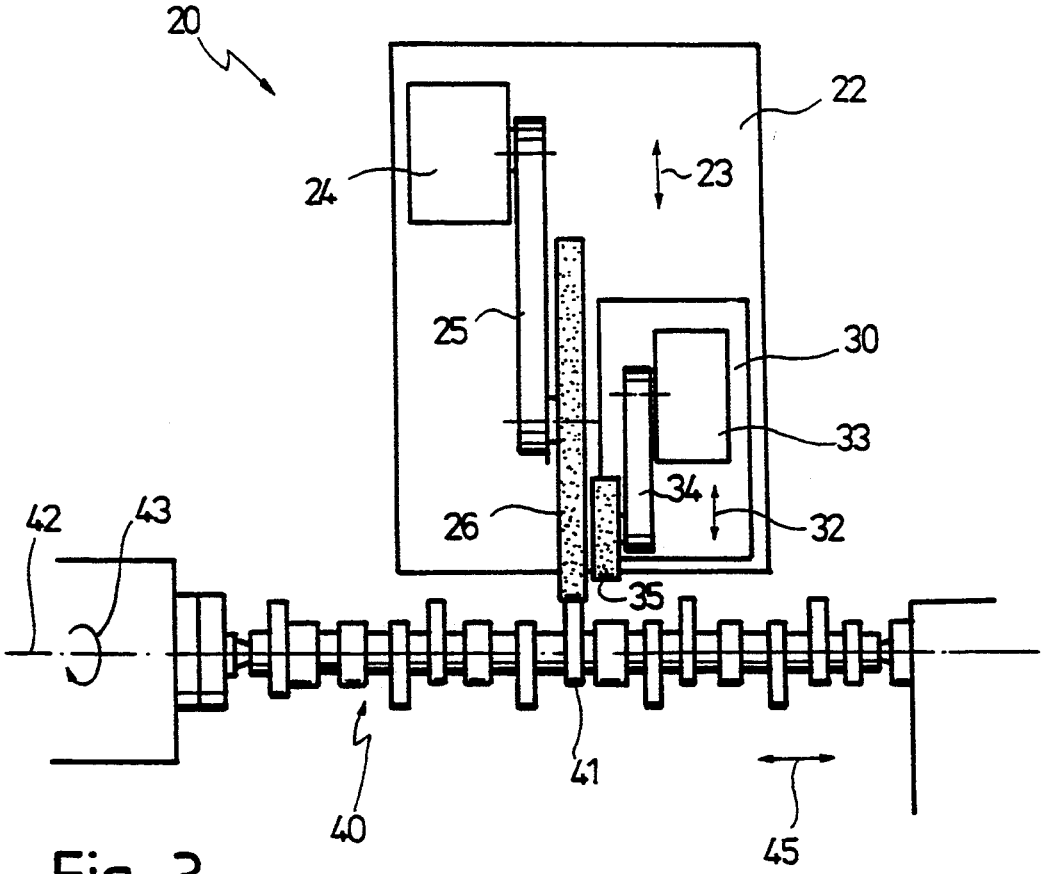
FIG. 3 shows a top view of the arrangement shown in FIG. 2.

FIGS. 2 and 3 depict, extremely schematically, an exemplary embodiment of a grinding machine that is designated 20 in its entirety.

In the grinding machine 20, a first grinding carriage 22 is conventionally arranged on a machine chassis 21 (not depicted in greater detail), so it can move in the direction of an arrow 23.

The arrow 23 designates the "X axis" in the technical language of grinding machine design.

Located on the first grinding carriage 22 is a first drive motor 24, by which a first grinding disk 26 with a large radius is driven by means of a first belt drive 25. The first grinding disk 26 is mounted in a first headstock 27.

To this extent the grinding machine 20 is of conventional design.

However, a second grinding carriage 30 is arranged on the top of the first headstock 27. For this purpose, the second grinding carriage is, for example, L-shaped in the side view of FIG. 2, with one horizontal arm and one vertical arm.

By means of a corresponding linear guide with a feed device, the second grinding carriage 30 can be moved relative to the first grinding carriage 22 along an arrow 32 that extends parallel to the X axis (arrow 23).

The horizontal arm of the second grinding carriage 30 carries a second drive motor 33, which drives a second grinding disk 35 via a second belt drive 34. The second grinding disk 35 is mounted in a second headstock 36 that is located at the front of the vertical arm of the second grinding carriage 30. The second grinding disk 35 is of considerably smaller radius than the first grinding disk 26.

In the position depicted in FIG. 2, the second grinding carriage 30 has moved to its right-hand end position relative to the first grinding carriage 22, with the result that the second, small grinding disk 35 projects to the right beyond the outer circumference of the first, large grinding disk 26.

In the top view of FIG. 3, however, the circumstances are reversed, since there the second grinding carriage 30 has been moved into its retracted (i.e. upper, in FIG. 3) end position relative to the first grinding carriage 22, in which the first, large grinding disk 26 projects forward (downward, as depicted in FIG. 3) beyond the outer contour of the second, small grinding disk 35.

In this position indicated in FIG. 3, the first, larger grinding disk 26 is in engagement with a cam 41 of a schematically depicted camshaft 40. The camshaft 40 is chucked in the usual manner, and can rotate about its long axis 42, known as the "C axis," as indicated by an arrow 43 .

To grind the cam 41, the camshaft 40 is rotated in the direction of the arrow 43 about the C axis 42 in the manner that is usual in numerically controlled grinding of cams, while at the same time the first grinding carriage 22 is moved back and forth in the direction of the arrow 23, i.e. along the X axis, so that the first grinding disk 26 is engaged, along a predefined cam contour, with the surface of the cam 41 when the latter is rotated.

The special feature of the grinding machine 20 depicted in FIGS. 2 and 3 lies in the fact that the first, larger grinding disk 26 and then the second, smaller grinding disk 35 can alternatively be brought into engagement with the cam 41 and the other cams of the camshaft 40. For this purpose, the camshaft is stepped relative to the first and second grinding carriages 22, 30, i.e. moved, in the direction of its long axis 42 that runs parallel to the Z axis (arrow 45), over a distance that corresponds exactly to the spacing between the grinding disks 26, 35 along the long axis 42 (arrow 45).

By moving the grinding carriages 22 and 30 relative to one another in the direction of the arrows 23, 32, it is then possible to bring one or the other grinding disk 26, 35 into engagement with the cam 41, and then to grind the surface of the cam 41 along a predefined contour.

The process sequence will now be explained in more detail with reference to the phase illustrations according to FIGS. 4 to 7.

To machine the cam 41 of a camshaft 40 in accordance with FIG. 3, first the unfinished camshaft 40 is chucked in a known manner, and the camshaft 40 is stepped relative to the grinding carriages 22 and 30 so that the first cam to be machined is aligned with the first, larger grinding disk 26. In the process, the grinding disks 22 and 30 are moved with respect to one another to produce the configuration depicted in FIG. 3, in which the first, larger grinding disk projects forward and is therefore effective when the first grinding carriage 22 is moved along the X axis 23 onto the camshaft 40.

Figure 4:
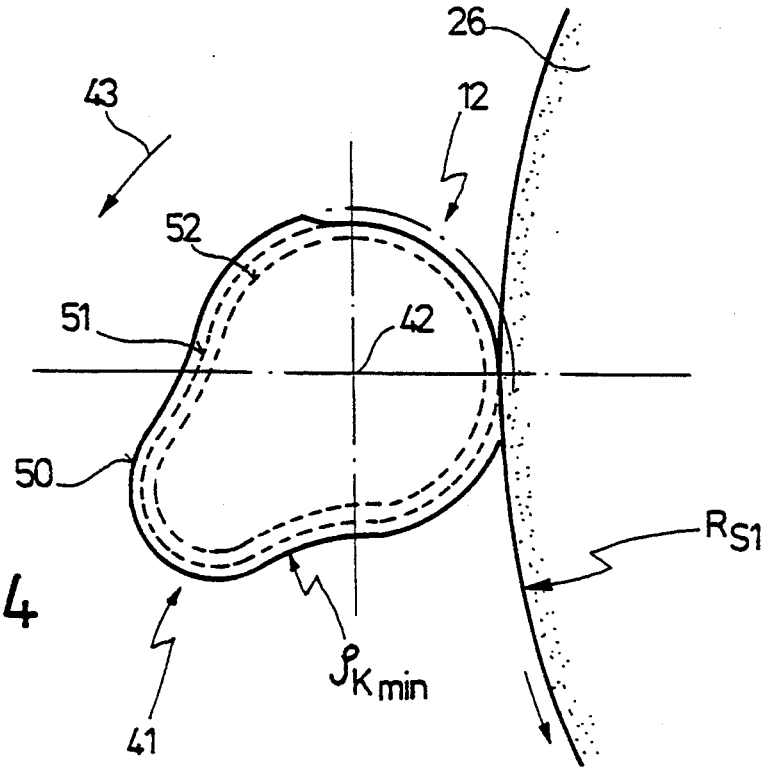
FIGS. 4–7 show four phase illustrations to explain steps in the process in accordance with the invention.

FIG. 4 then shows that in the original state the cam 41 has an unfinished contour 50 that corresponds to the unmachined surface of the camshaft blank. An intermediate contour 51 characterizes the final state after the cam 41 has been roughed down, while a final contour 52 denotes the final state after the cam 41 has been finish ground. It is understood that the depiction of FIGS. 4 to 7 is not to scale, since the machining allowance between the unfinished contour and intermediate contour, i.e. the machining allowance for the roughing process, is of course considerably greater than the allowance between the intermediate contour 51 and final contour 52, i.e. the finish grinding allowance.

FIG. 4 shows a situation in which the first, larger grinding disk 26 is already in engagement with the cam 41 and has already ground from the unfinished contour 50 to the intermediate contour 51 over a certain portion of the base circle segment. It is understood that FIG. 1 depicts conditions only in simplified form, since of course the process of grinding from the unfinished contour 50 to the intermediate contour 51 usually occurs in several step, and not in only one step as shown by FIG. 4.

For this purpose, the grinding disk 26 is advanced, in an advance operation, in regions of the base circle from the unfinished contour 50 up to the intermediate contour 51, while no along-path operation is required in this region, since the base circle radius (cf. FIG. 1) is constant in this region. Only after leaving the base circle segment is along-path travel necessary; with this, an oscillating movement of the grinding disk 26 along the X axis 23 is superimposed on the rotation of the cam 41 about the C axis 42.

It is clearly evident from FIG. 4 that the minimum radius of curvature $\rho_{k\ min}$ is considerably smaller than the radius $R_{s1}$ of the grinding disk 26. For example, the minimum radius of curvature $\rho_{k\ min}$ is less than the radius $R_{s1}$ of the grinding disk 26 by a factor of 10.

For the reasons explained earlier, it is therefore impossible to grind the intermediate contour 51 exactly using the grinding disk 26, since in the concave region the large grinding disk 26 cannot reach to the base of the intermediate contour 51 without causing geometrical errors in the contiguous pre-cam segment and tip circle segment.

For these reasons, the grinding process according to FIG. 4 proceeds in such a way that the grinding disk 26 is guided not along the intermediate contour 51, but instead along a modified intermediate contour 51'. The modified intermediate contour 51' is designed so that its minimum radius of curvature is greater than the radius $R_{s1}$ of the grinding disk 26. The modified intermediate contour 51' can therefore be ground, without geometrical errors, using the large grinding disk 26.

However, the result of the modification in the intermediate contour 51/51' is that in the concave curvature region, i.e. in the catch segment 13*a* and runout segment 13*b* of the cam (cf. FIG. 1), there remain behind zones 55*a*, 55*b* that lie outside the inherently desired intermediate contour 51.

Figure 5:
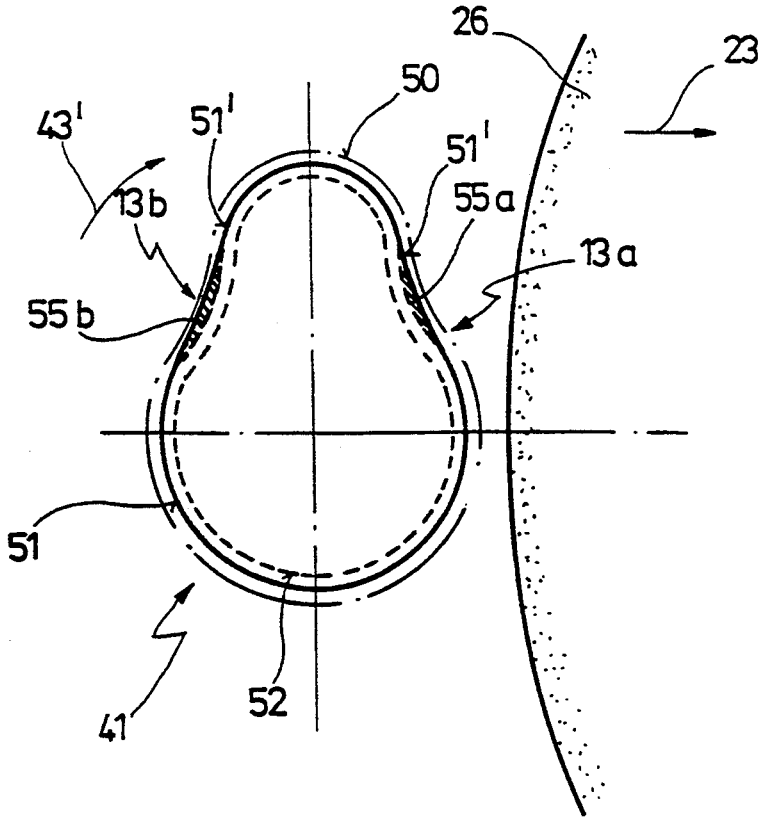

When the first grinding disk 26 has finished grinding the modified intermediate contour 51', the camshaft is then stepped relative to the grinding disk 26, and the second and further cams to be machined are ground in the same way along modified intermediate contours, until all the cams of the camshaft 40 have been machined. In a fast traverse, the grinding disk 26 is moved by means of the carriage 22 along the X axis into the starting position (FIG. 5).

The camshaft 40 now moves with the most recently machined cam into the position of the grinding disk 35, but the camshaft is stepped over a distance that corresponds to the spacing between the grinding disks 26, 35 along the long axis 42 (arrow 45). At the same time the grinding carriages 22 and 30 are moved relative to one another along the X axis 23 so that now the smaller, second grinding disk 35 projects forward (cf. FIG. 2). At the same time the camshaft 40 is brought, in a rapid traverse (arrow 43), from the starting position to an angular position (FIG. 6*a*) in which exactly one of the zones 55*a*, 55*b*—in the example of FIG. 6*a*, zone 55*a*—is now located in the direction of the X axis 23, with reference to the engagement line of the second, smaller grinding disk 35.

The camshaft 40 is halted in this angular position, i.e. rotation is stopped. The second, smaller grinding disk 35 has a radius $R_{s2}$ that is smaller than the minimum radius of curvature $\rho_{k\ min}$ in the concave curvature region of the cam 41. The second, smaller grinding disk 35 is now advanced, according to FIG. 6*a*, in the direction of arrow 23 onto the cam 41, so that with the grinding disk 35 in the position according to FIG. 6*b*, the zone 55*a* is essentially completely ground away by plunge grinding.

The grinding disk 35 is then moved by means of the carriage 22, in a fast traverse operation, in the direction of the X axis 23 into the starting position.

Figure 6A:
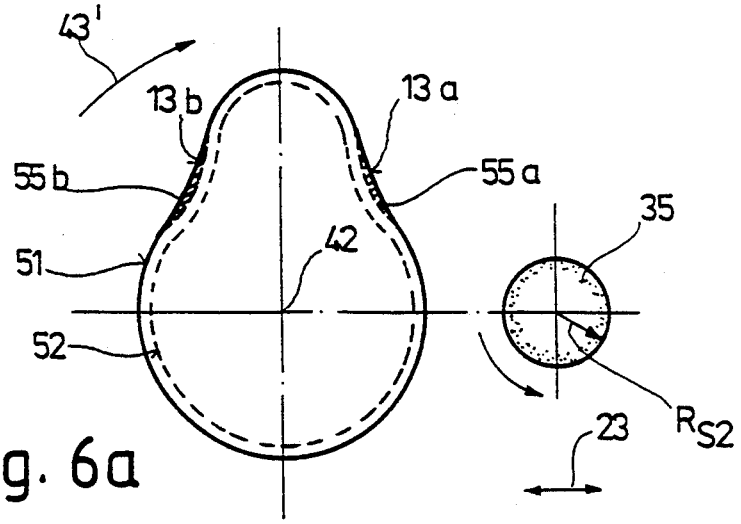
Figure 6B:
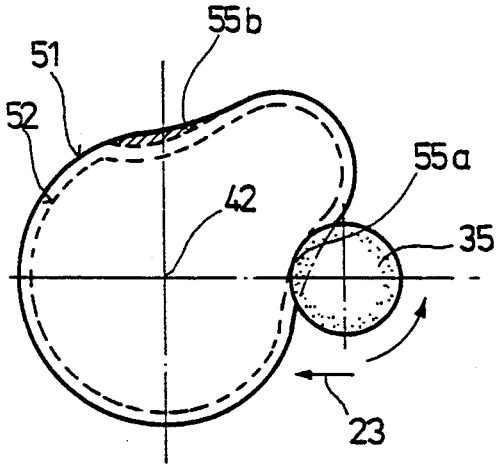
Figure 6C:
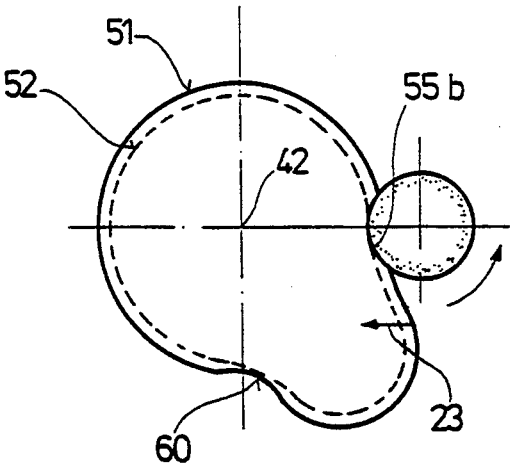

In a rapid traverse, the cam 41 is now rotated so that in the same way, the other zone 55*b* is ground away by plunge grinding, again with the cam 41 stationary. FIG. 6*c* shows this procedure. Then the grinding disk 35 is moved by means of the carriage 22, in a fast traverse, in the direction of the X axis into the starting position, as depicted in FIG. 6*a*.

Figure 7:
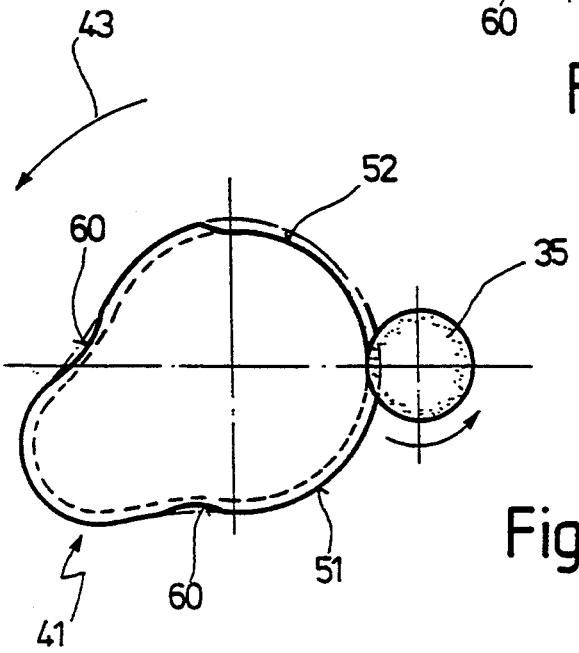

FIG. 7 shows the final procedure, in which the cam 41 is ground, in a conventional manner, from the intermediate contour 51 to the final contour 52, specifically by means of the second grinding disk 35, which is now guided exactly along the final contour 52. In FIG. 7, 60 indicates the plunge areas that were previously produced by plunge grinding as shown in FIG. 6. The plunge grinding removed so much material in the region of the zones 55*a*, 55*b* that during finish grinding as shown in FIG. 7, even in the concave curvature there remains so little material to remove that this can be done in one working step.

It is also understood that grinding from the intermediate contour 51 to the final contour 52 can also occur in multiple steps, and not only in one step as shown in FIG. 7. The same procedure—plunge grinding with a stationary workpiece (FIGS. 6*a, b, c*) and finish grinding (FIG. 7)—is then repeated by again stepping the camshaft 40 relative to the second grinding disk 35 to all the other cams of the camshaft 40, so that ultimately all the cams of the camshaft 40 have been ground.

In a practical application, a CBN grinding disk 450 mm in diameter is used as the first grinding disk 26 to grind cams 41 of a steel camshaft 40.

For rough grinding in accordance with FIG. 4, the first grinding disk 26 is operated at a circumferential velocity $v_s = 100$ m/s, which corresponds to a rotation speed of approximately $n = 4300$ rpm. However, the cutting velocity $v_s$ can also be varied, for example in the range between 50 and 300 m/s.

The camshaft 40 is rotated at an angular velocity $\omega$ about the C axis 42, with the angular velocity $\omega$ being varied in steps. During machining of the base circle segment 12 it is, for example, 35,000 degrees/min; during machining of the tip circle segment 14, 15,000 degrees/min; and during machining of the flanks 13*a*, 13*b*, for example 8000 degrees/min.

The machining allowance between the unfinished contour 50 and the intermediate contour 51 for rough grinding is for example 0.55 mm, which is removed in six revolutions of the camshaft 41, resulting in an advance of approximately 0.09 mm for each revolution.

If the minimum radius of curvature $\rho_{k\ min}$ in the concave curved regions 13*a*, 13*b* of the cam 41 is, for example, 50 mm, then a CBN grinding disk with, for example, a diameter of 80 mm, the radius of which (40 mm) is thus less than the minimum radius of curvature, can be used as the second grinding disk 35.

For more precise determination of the allowable radius of the second grinding disk 35, it is assumed that the dynamic relationships to the cam contour at the controlled contact point must be taken into account in order to minimize osculation at the point where material is removed. This leads to the following formula:

$$R_{s2} = f\left(\rho_{k\ min};\ \frac{d^2S_N}{d\phi^2};\ \omega_k\right)$$

where $\rho_{k\ min}$ is the minimum radius of curvature in the concave region of the cam, which is for example 50 mm, and $d^2S_N/d\phi^2$ is the circumferential acceleration of the engagement line between the second grinding disk 35 and the cam 41, and with the specified cam contour is, for example, 0.0164 mm/degree$^2$. $\omega_k$ is the angular velocity of the cam 41 during rotation about the C axis 42 in the region of the hollow flanks. If $\omega_k$ is 8,000 degrees/min, the radius $R_{s2}$ of the second, smaller grinding disk 35 is thus only 0.76 times the minimum radius of curvature $\rho_{k\ min}$, while at an angular velocity $\omega_k$ of 4,000 degrees/min a factor of 0.87 needs to be used.

To define more precisely the formula given above for the allowable radius $R_{s2}$ of the second grinding disk 35, it is possible to determine the exact functional relationship by analysis. To do so, one first considers, as additional starting variables, the elevation angle $\phi_{E1}$ at the beginning of the elevation, and the elevation angle $\phi_{Ei}$ at the points of maximum circumferential acceleration $d^2S_N/d\phi^2$ of the engagement line between the second grinding disk 35 and the cam 47. We then get, as an auxiliary variable $\Delta\phi$:

$$\Delta\phi=\phi_{Ei}-\phi_{EI}.$$

If we then consider a further auxiliary variable $b_{max}$:

$$b_{max}=(d^2S_N/d\phi^2)(\Delta\phi/\pi)^2(\Delta\phi/\phi_{Ei})^2$$

the formula indicated above for the radius $r_{s2}$ can then be written as follows:

$$R_{s2} = \rho_{kmin}\left(1 - b_{max}\frac{\omega_k}{\Delta \cdot C \cdot v_x}\right)$$

where C is the preset angular increment in the concave region and $V_x$ is the maximum axial velocity in the direction of the X axis.

In a quantitative example, let us assume the following:

$d^2S_N/d\phi^2=0.0164$ mm/degree$^2$
$\phi_{Ei}=138$ degrees
$\phi_{EI}=94$ degrees
$\rho_{k\,min}=46.7822$ mm
$\Delta C=1$ degree
$\omega_k=8000$ and 4000 degrees/min
$v_x=10{,}000$ mm/min The auxiliary variables then become:

$\Delta\phi=44$ degrees
$b_{max}=0.3274$ mm/rad$^2$ and lastly the grinding disk radius is:

$R_{s2}=35$ mm ($\omega_k=8000$ degrees/min)
$R_{s2}=40$ mm ($\omega_k=4000$ degrees/min)

Once the allowable radius $R_{s2}$ of the second, smaller grinding disk 35 has been determined in this manner, it can be used, for example, at a cutting velocity $v_s=100$ m/s, which corresponds to a rotation speed n=24,000 rpm. If the advance per revolution of the second grinding disk 35 during plunge grinding according to FIG. 6 is then set at 0.1 μm, this results—with a feed velocity of, for example 23.9 mm/min and a depth of, for example, 0.16 mm for the zones 55*a*, 55*b*—in a machining time of 0.4 seconds.

For finish grinding according to FIG. 7, the second grinding disk 35 is driven at the same rotation speed or cutting velocity. However, the angular velocities for rotation of the cam 41 about the C axis 42 are set slightly differently as compared with the roughing procedure according to FIG. 4, specifically at 25,000 degrees/min in the base circle segment 12, 8000 degrees/min in the tip circle segment 14, and 4000 degrees/min in the region of the flanks 13*a*, 13*b*.

During finish grinding according to FIG. 7, the machining allowance between the intermediate contour 7 and final contour 52 is, for example, 50 μm, which is ground away in ten revolutions of the camshaft 41.

It is understood that the exemplary embodiment presented quantitatively above is only one of many possible exemplary embodiments, and that therefore the invention is not limited by the quantitative information indicated.

What is claimed is:

1. A method for numerically controlled grinding of cams of a camshaft, said cams having a convex circular base section and a convex circular tip section, said base and tip sections being interconnected by a transitional mounting section and a transitional descending section, respectively, said transitional sections having a concave shape with a predetermined minimum radius of curvature ($\rho_{k\,min}$), a first cam contour being defined by said cam in a raw condition and a second cam contour being defined by said cam in a ground condition, the method comprising the steps of:

chucking said camshaft in a rotary chuck;

rotating said camshaft about a longitudinal axis thereof;

grinding said cam with a first grinding wheel having a radius ($R_{s1}$) much bigger than said minimum radius of curvature ($\rho_{k\,min}$), said cam being ground along a third cam contour corresponding to said second cam contour along said convex base and tip sections and being between said first and said second cam contours along said concave transitional sections, thus leaving a zone of unground cam material in said concave transitional sections, as compared with said second cam contour; and thereafter grinding said cam with a second grinding wheel having a radius ($R_{s2}$) smaller than said minimum radius of curvature ($\rho_{k\,min}$).

2. The method of claim 1, wherein after grinding with said first grinding wheel said cam is brought to a stop and said zone is essentially ground away with said second grinding wheel by plunge grinding with said cam remaining stationary.

3. The method of claim 2, wherein said cam is again rotated after said plunge grinding and is finally ground with said second grinding wheel along said second cam contour.

* * * * *